US006138696A

United States Patent [19]

Labit, Jr. et al.

[11] Patent Number: 6,138,696

[45] Date of Patent: Oct. 31, 2000

[54] NONSPLASHING WASHING SYSTEM

[76] Inventors: Morris J. Labit, Jr.; Belle G. Blanchard, both of 400 Ann Carol St., Houma, La. 70360

[21] Appl. No.: 08/648,379

[22] Filed: May 15, 1996

[51] Int. Cl.[7] ..... B08B 3/04

[52] U.S. Cl. ..... 134/117; 134/135; 134/154; 134/196; 134/201

[58] Field of Search ..... 134/117, 135, 134/147, 154, 164, 196, 197, 201; 126/544

[56] References Cited

U.S. PATENT DOCUMENTS

| | | | |
|---|---|---|---|
| 135,176 | 1/1873 | Usher | 134/117 |
| 1,536,020 | 4/1925 | Kenner | 134/135 |
| 1,745,466 | 2/1930 | Anschicks | 134/135 |
| 2,318,842 | 5/1943 | Eaton | 134/135 |
| 2,668,549 | 2/1954 | Lebus | 134/135 |
| 3,894,551 | 7/1975 | Stohlman | 134/135 |
| 3,971,394 | 7/1976 | Osborne | 134/111 |
| 4,146,404 | 3/1979 | Williams, Jr. | 134/135 |
| 4,630,593 | 12/1986 | Gremillion . | |
| 5,000,209 | 3/1991 | Mann | 134/135 |

*Primary Examiner*—Frankie L. Stinson

[57] ABSTRACT

A new Nonsplashing Washing System for preventing splashing of a hazardous liquid when cleaning parts and for preventing the hazardous liquid from igniting by using a fire retarding screen. The inventive device includes a solvent container, a compression spring within the solvent container, a cleaning solvent partially filling the solvent container, and a fire retarding screen within the solvent container engaging the compression spring.

4 Claims, 3 Drawing Sheets

FIG 1
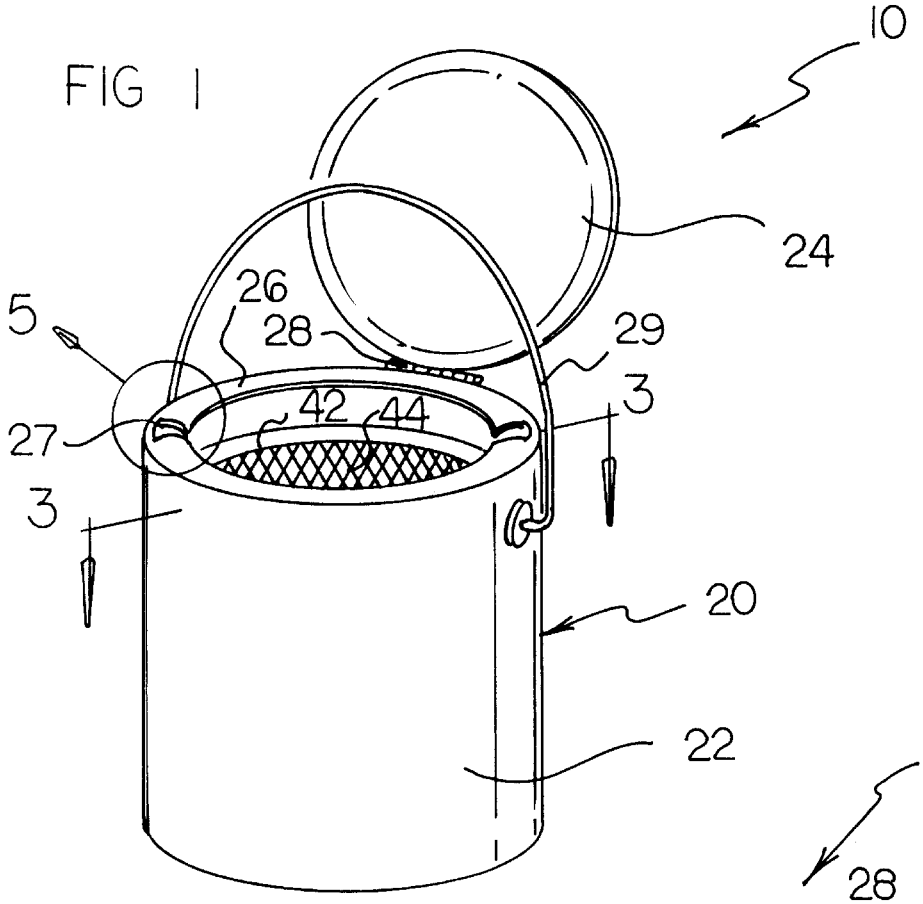
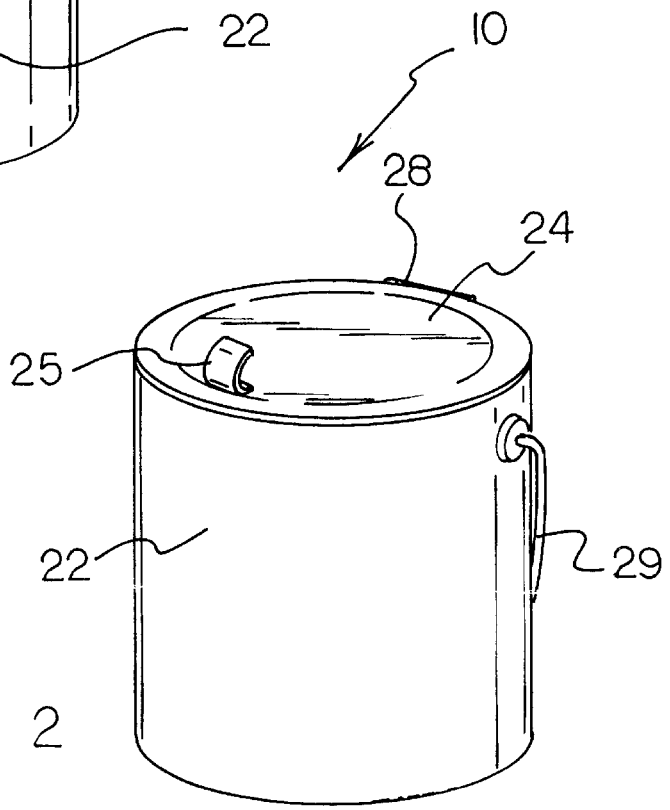
FIG 2

FIG 3
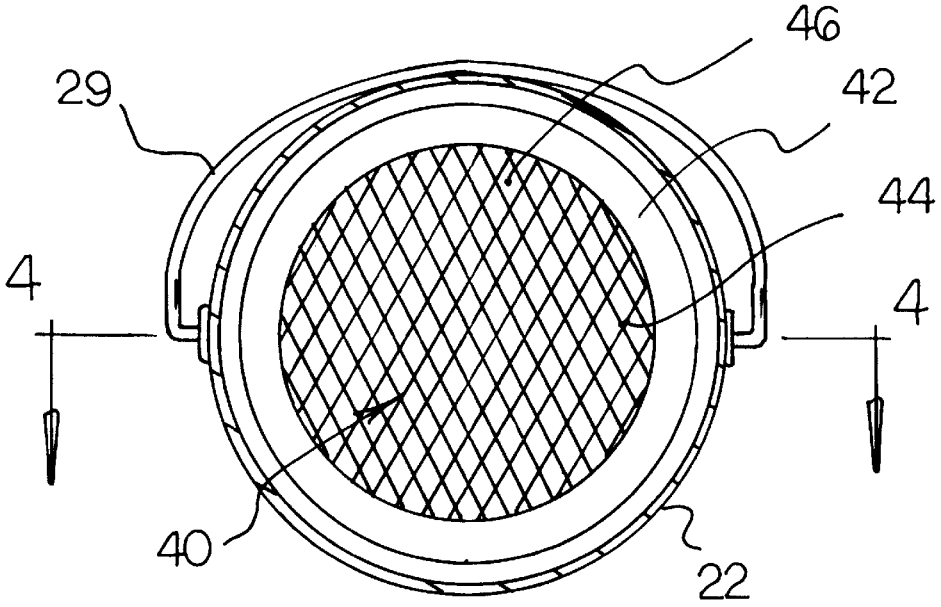
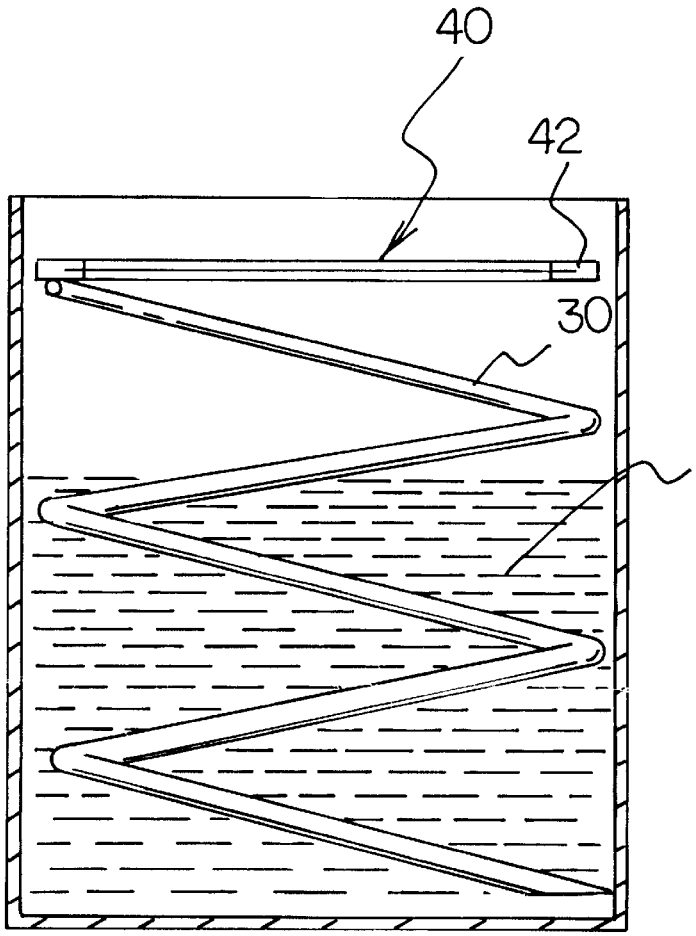
FIG 4

FIG 5
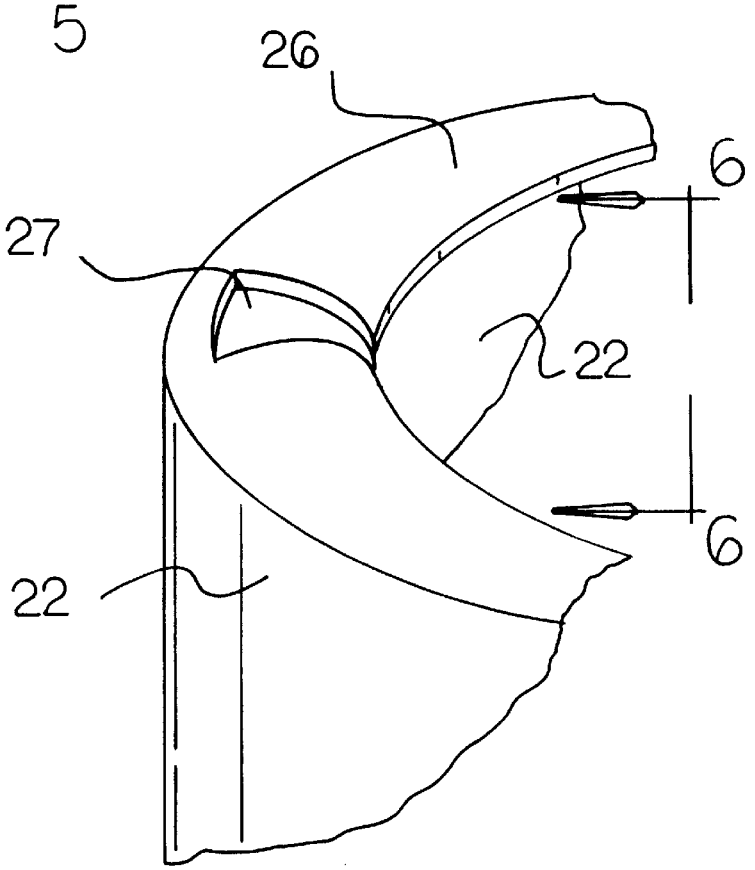
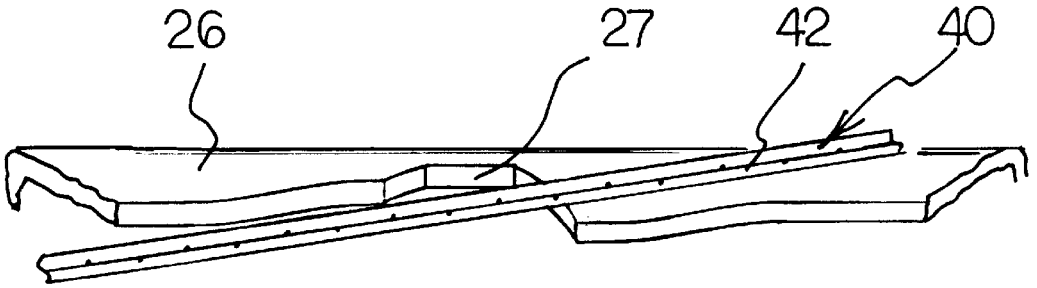
FIG 6

NONSPLASHING WASHING SYSTEM

BACKGROUND OF THE INVENTION

1. Field of the Invention

The present invention relates to Cleaning Devices and more particularly pertains to a new Nonsplashing Washing System for preventing splashing of a hazardous liquid when cleaning parts and for preventing the hazardous liquid from igniting by using a fire retarding screen.

2. Description of the Prior Art

The use of Cleaning Devices is known in the prior art. More specifically, Cleaning Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Cleaning Devices include U.S. Pat. No. 5,232,299; U.S. Pat. No. 5,056,948; U.S. Pat. No. 5,299,587; U.S. Pat. No. 4,995,409; U.S. Pat. No. 3,890,988 and U.S. Design Pat. No. 271, 146.

While these devices fulfill their respective, particular objectives and requirements, the aforementioned patents do not disclose a new Nonsplashing Washing System. The inventive device includes a solvent container, a compression spring within the solvent container, a cleaning solvent partially filling the solvent container, and a fire retarding screen within the solvent container engaging the compression spring.

In these respects, the Nonsplashing Washing System according to the present invention substantially departs from the conventional concepts and designs of the prior art, and in so doing provides an apparatus primarily developed for the purpose of preventing splashing of a hazardous liquid when cleaning parts and for preventing the hazardous liquid from igniting by using a fire retarding screen.

SUMMARY OF THE INVENTION

In view of the foregoing disadvantages inherent in the known types of Cleaning Devices now present in the prior art, the present invention provides a new Nonsplashing Washing System construction wherein the same can be utilized for preventing splashing of a hazardous liquid when cleaning parts and for preventing the hazardous liquid from igniting by using a fire retarding screen.

The general purpose of the present invention, which will be described subsequently in greater detail, is to provide a new Nonsplashing Washing System apparatus and method which has many of the advantages of the Cleaning Devices mentioned heretofore and many novel features that result in a new Nonsplashing Washing System which is not anticipated, rendered obvious, suggested, or even implied by any of the prior art Cleaning Devices, either alone or in any combination thereof.

To attain this, the present invention generally comprises a solvent container, a compression spring within the solvent container, a cleaning solvent partially filling the solvent container, and a fire retarding screen within the solvent container engaging the compression spring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Nonsplashing Washing System apparatus and method which has many of the advantages of the Cleaning Devices mentioned heretofore and many novel features that result in a new Nonsplashing Washing System which is not anticipated, rendered obvious, suggested, or even implied by any of the prior art Cleaning Devices, either alone or in any combination thereof.

It is another object of the present invention to provide a new Nonsplashing Washing System which may be easily and efficiently manufactured and marketed.

It is a further object of the present invention to provide a new Nonsplashing Washing System which is of a durable and reliable construction.

An even further object of the present invention is to provide a new Nonsplashing Washing System which is susceptible of a low cost of manufacture with regard to both materials and labor, and which accordingly is then susceptible of low prices of sale to the consuming public, thereby making such Nonsplashing Washing System economically available to the buying public.

Still yet another object of the present invention is to provide a new Nonsplashing Washing System which provides in the apparatuses and methods of the prior art some of the advantages thereof, while simultaneously overcoming some of the disadvantages normally associated therewith.

Still another object of the present invention is to provide a new Nonsplashing Washing System for preventing splashing of a hazardous liquid when cleaning parts and for preventing the hazardous liquid from igniting by using a fire retarding screen.

Yet another object of the present invention is to provide a new Nonsplashing Washing System which includes a solvent container, a compression spring within the solvent container, a cleaning solvent partially filling the solvent container, and a fire retarding screen within the solvent container engaging the compression spring.

Even still another object of the present invention is to provide a new Nonsplashing Washing System wherein the cleaning solvent is unable to splash out of the solvent container.

Still another object of the present invention is to provide a new Nonsplashing Washing System that facilitates agitation of the parts within the cleaning solvent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side perspective view of a new Nonsplashing Washing System with the sealing lid retracted exposing the fire retarding screen according to the present invention.

FIG. 2 is a side perspective view of the present invention with the sealing juxtaposed to the pail container.

FIG. 3 is a cross sectional view taken along line 3—3 of FIG. 1 disclosing the fire retarding screen.

FIG. 4 is a cross sectional view taken along line 4—4 of FIG. 3 exposing the compression screen engaging the fire retarding screen.

FIG. 5 is a magnified cut-away view of the screen retaining lip and the lip aperture.

FIG. 6 is a magnified cut-away view of the screen retaining lip with the fire retarding screen projecting through the lip aperture.

DESCRIPTION OF THE PREFERRED EMBODIMENT

With reference now to the drawings, and in particular to FIGS. 1 through 6 thereof, a new Nonsplashing Washing System embodying the principles and concepts of the present invention and generally designated by the reference numeral 10 will be described.

More specifically, it will be noted that the Nonsplashing Washing System 10 comprises a solvent container 20, a compression spring 30 freely positioned within the solvent container 20 where one end of the compression spring 30 is juxtaposed to the bottom interior surface of the solvent container 20, a cleaning solvent occupies the interior of the solvent container 20, and a fire retarding screen 40 slidably positioned within the upper portion of the solvent container 20 where the fire retarding screen 40 engages the compression spring 30 opposite of the bottom interior surface of the solvent container 20.

As best illustrated in FIGS. 1 through 6, it can be shown that the solvent container 20 includes a pail container 22 substantially cylindrical shaped. A sealing lid 24 is formed to seal the opening of the pail container 22. The sealing lid 24 is pivotally secured to the pail container 22 by a hinge 28 secured to both the pail container 22 and the sealing lid 24. A lid handle 25 is secured to top surface of the sealing lid 24 opposite of the hinge 28 as shown in FIG. 2 of the drawings. A semi-circular handle's 29 ends are rotatably secured to opposite exterior sides of the pail container 22 providing a carrying means for the user. A screen retaining lip 26 surrounds the opening of the pail container 22 projecting toward the vertical center of the solvent container 20. The screen retaining lip 26 contains at least two screen removing apertures 27 where the fire retarding screen 40 projects through during removal of the fire retarding screen 40 as best shown in FIG. 6 of the drawings. The fire retarding screen 40 includes a circular screen rim 42 with a smaller outside diameter than the interior diameter of the pail container 22 allowing the fire retarding screen 40 to slide about the interior of the pail container 22. The circular screen rim 42 has an outside diameter which is greater than the inside diameter of the screen retaining lip 26 thereby retaining the fire retarding screen within the pail container 22. A reticulated screen 44 is secured to the circular screen rim 42 as best shown in FIG. 3 of the drawings. The reticulated screen 44 preferably has a plurality of lozenge shaped apertures 46. The lozenge shaped apertures 46 are preferably small enough to prevent sufficient air to penetrate the fire retarding screen 40 to maintain a fire of the cleaning solvent.

In use, the user opens the sealing lid 24 which exposes the fire retarding screen 40. The user places unnumbered parts desired to be cleaned upon the fire retarding screen 40 and places a downward force upon the fire retarding screen 40 thereby descending the unnumbered parts into the cleaning solvent 50 and retracting the compression spring 30 engaged to the fire retarding screen 40. The user then removes the downward force where the compression spring 30 forces the fire retarding screen 40 supporting the unnumbered parts above the cleaning solvent 50 level in the pail container 22. Repeating the above movements agitates the unnumbered parts with the cleaning solvent 50 thereby removing undesired debris therefrom. The fire retarding screen 40 prevents the cleaning solvent 50 from splashing upon the user if the solvent container 20 is accidentally jarred. The fire retarding screen 40 further prevents the cleaning solvent 50 from catching on fire by preventing air from freely flowing into the pail container 22. When the user is finished cleaning the unnumbered parts, the user closes the sealing lid 24 against the pail container 22 preventing the cleaning solvent 50 from evaporating.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Nonsplashing Washing System comprising:

a solvent container;

a compression spring freely positioned within the solvent container where one end of the compression spring is juxtaposed to the bottom interior surface of the solvent container;

a cleaning solvent occupies the interior of the solvent container; and a fire retarding screen slidably positioned within the upper portion of the solvent container, where the fire retarding screen engages the compression spring opposite of the bottom interior surface of the solvent container.

2. The Nonsplashing Washing System of claim 1, wherein the solvent container includes:

a pail container;

a sealing lid formed to seal the opening of the pail container pivotally secured to the pail container by a hinge;

a lid handle secured to top surface of the sealing lid opposite of the hinge;

a semi-circular handle with the ends rotatably secured to opposite exterior sides of the pail container; and a screen retaining lip around the opening of the pail container projecting toward the vertical center of the solvent container where the screen retaining lip contains at least two screen removing apertures where the fire retarding screen projects through during removal.

3. The Nonsplashing Washing System of claim 2, wherein the fire retarding screen includes:

a circular screen rim with a smaller outside diameter than the interior diameter of the pail container and where the circular screen rim outside diameter is greater than the inside diameter of the screen retaining lip;

a reticulated screen secured to the circular screen rim; and the reticulated screen with a plurality of lozenge shaped apertures.

4. The Nonsplashing Washing System of claim 3, wherein the lozenge shaped apertures are small enough to prevent sufficient air to penetrate the fire retarding screen to maintain a fire of the cleaning solvent.

* * * * *